US011248368B2

(12) United States Patent
Rosko et al.

(10) Patent No.: US 11,248,368 B2
(45) Date of Patent: Feb. 15, 2022

(54) FAUCET AERATOR WITH CENTER STREAM

(71) Applicant: Delta Faucet Company, Indianapolis, IN (US)

(72) Inventors: Michael Scot Rosko, Greenwood, IN (US); Mark Cipriani, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 15/487,862

(22) Filed: Apr. 14, 2017

(65) Prior Publication Data

US 2017/0298600 A1 Oct. 19, 2017

Related U.S. Application Data

(60) Provisional application No. 62/322,777, filed on Apr. 14, 2016.

(51) Int. Cl.
*E03C 1/084* (2006.01)
*E03C 1/02* (2006.01)

(52) U.S. Cl.
CPC ..... *E03C 1/084* (2013.01); *E03C 2001/026* (2013.01)

(58) Field of Classification Search
CPC ..... E03C 1/084; E03C 2001/026; E03C 1/08; E03C 1/086; E03C 1/108; B05B 1/3006; B05B 1/18
USPC ..... 239/428.5, 8
See application file for complete search history.

(56) References Cited

U.S. PATENT DOCUMENTS

| | | | | |
|---|---|---|---|---|
| 2,950,063 | A * | 8/1960 | Ripley, Jr. | E03C 1/084 239/407 |
| 4,072,270 | A * | 2/1978 | Harmony | E03C 1/084 239/428.5 |
| 4,082,091 | A | 4/1978 | Raab | |
| 4,637,552 | A * | 1/1987 | Finkbeiner | E03C 1/084 239/428.5 |
| 5,348,231 | A * | 9/1994 | Arnold | E03C 1/084 239/428.5 |
| 5,467,929 | A * | 11/1995 | Bosio | B01F 3/0473 239/428.5 |
| 7,850,098 | B2 | 12/2010 | Vogel et al. | |
| 8,006,922 | B2 | 8/2011 | Katzer | |
| 8,308,079 | B2 | 11/2012 | Grether et al. | |
| 8,424,781 | B2 | 4/2013 | Rosko et al. | |
| D684,241 | S | 6/2013 | Tempel | |
| 8,561,922 | B2 | 10/2013 | Staedtler | |
| D745,641 | S | 12/2015 | Blum | |
| 9,481,986 | B2 | 11/2016 | Zoller et al. | |

(Continued)

OTHER PUBLICATIONS

NEOPERL: Perlator Honeycomb Flow Thru Aerator with Dual Stream, retrieved from http://www.neoperl.net/en/oem/products/aerators/productlines/perlatorhcflowthru.html, on May 26, 2017.

(Continued)

*Primary Examiner* — Alex M Valvis
*Assistant Examiner* — Christopher R Dandridge
(74) *Attorney, Agent, or Firm* — Bose McKinney & Evans LLP

(57) ABSTRACT

An aerator including a faceplate for dispensing a first water stream, and a nozzle for dispensing a second water stream, the second water stream surrounded by the first water stream.

22 Claims, 6 Drawing Sheets

(56) References Cited

U.S. PATENT DOCUMENTS

| | | | | |
|---|---|---|---|---|
| 2008/0251604 | A1* | 10/2008 | Schmid | E03C 1/084 239/113 |
| 2013/0008980 | A1 | 1/2013 | Grether | |
| 2015/0252555 | A1* | 9/2015 | Huang | E03C 1/084 239/428.5 |

OTHER PUBLICATIONS

NEOPERL: Autoclean Aerator, retrieved from http://www.neoperl.net/en/oem/products/aerators/productlines/autoclean.html, on Apr. 4, 2016.

* cited by examiner

FAUCET AERATOR WITH CENTER STREAM

CROSS-REFERENCE TO RELATED APPLICATION

This application claims priority to U.S. Provisional Patent Application Ser. No. 62/322,777, filed Apr. 14, 2016, the disclosure of which is expressly incorporated herein by reference.

BACKGROUND AND SUMMARY OF THE DISCLOSURE

The present invention relates to fluid delivery devices and, more particularly, to a faucet aerator.

In the interest of water conservation, fluid delivery devices (e.g., faucets) are often now required to deliver water at reduced flow rates. In faucets including outlet aerators, such reduced flow rates may provide the user with a low impact or "soft" aerated water stream. Enhanced water impact is often desired for certain tasks, such as cleaning a razor or a toothbrush.

The present invention provides a faucet that delivers water with enhanced force or impact at lower flow rates.

According to an illustrative embodiment of the present disclosure, a faucet aerator includes a housing having a faceplate with a plurality of spaced apart openings to discharge a first water stream. A nozzle is supported by the housing and is configured to discharge a second water stream positioned radially inwardly of the first water stream. Illustratively, the second water stream has a greater flow velocity than the first water stream. Further illustratively, the first water stream is an aerated stream of water, and the second water stream is a substantially laminar stream of water.

According to a further illustrative embodiment of the present disclosure, a faucet aerator includes a first portion for dispensing an aerated stream of water having a first flow velocity, and a second portion for dispensing a center stream of water surrounded by the aerated stream of water, the center stream of water having a second flow velocity greater than the first flow velocity.

According to another illustrative embodiment of the present disclosure, a method of dispensing water includes the steps of providing a housing, a faceplate supported by the housing, and a nozzle supported by the housing, discharging a first water stream from the faceplate, and discharging a second water stream from the nozzle. The second water stream is surrounded by the first water stream.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF DRAWINGS

A detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention.

Figure 1:
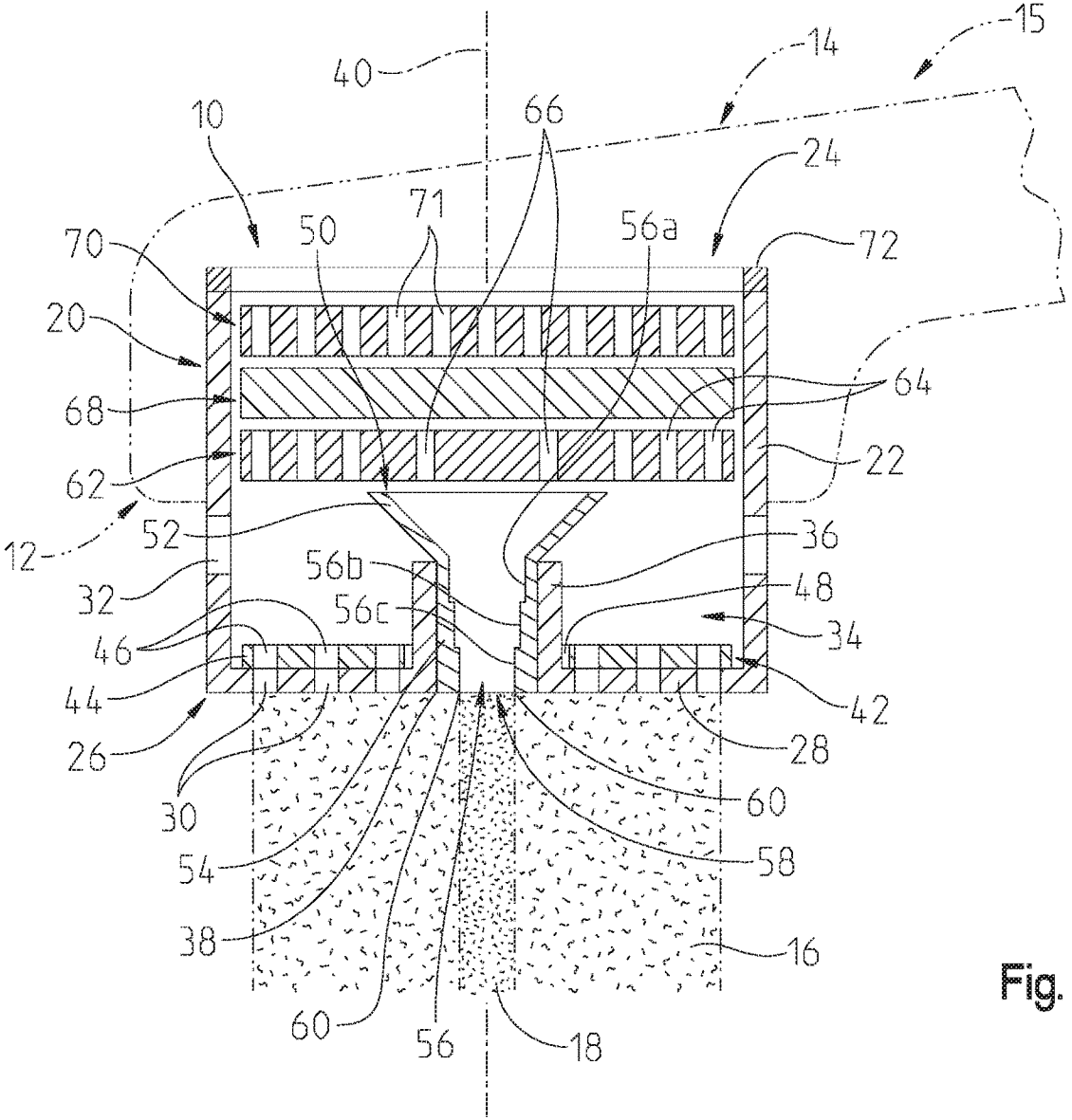
FIG. 1 is a diagrammatic cross-sectional view of an illustrative aerator of the present disclosure coupled to an outlet end of a faucet delivery spout.
Figure 2:
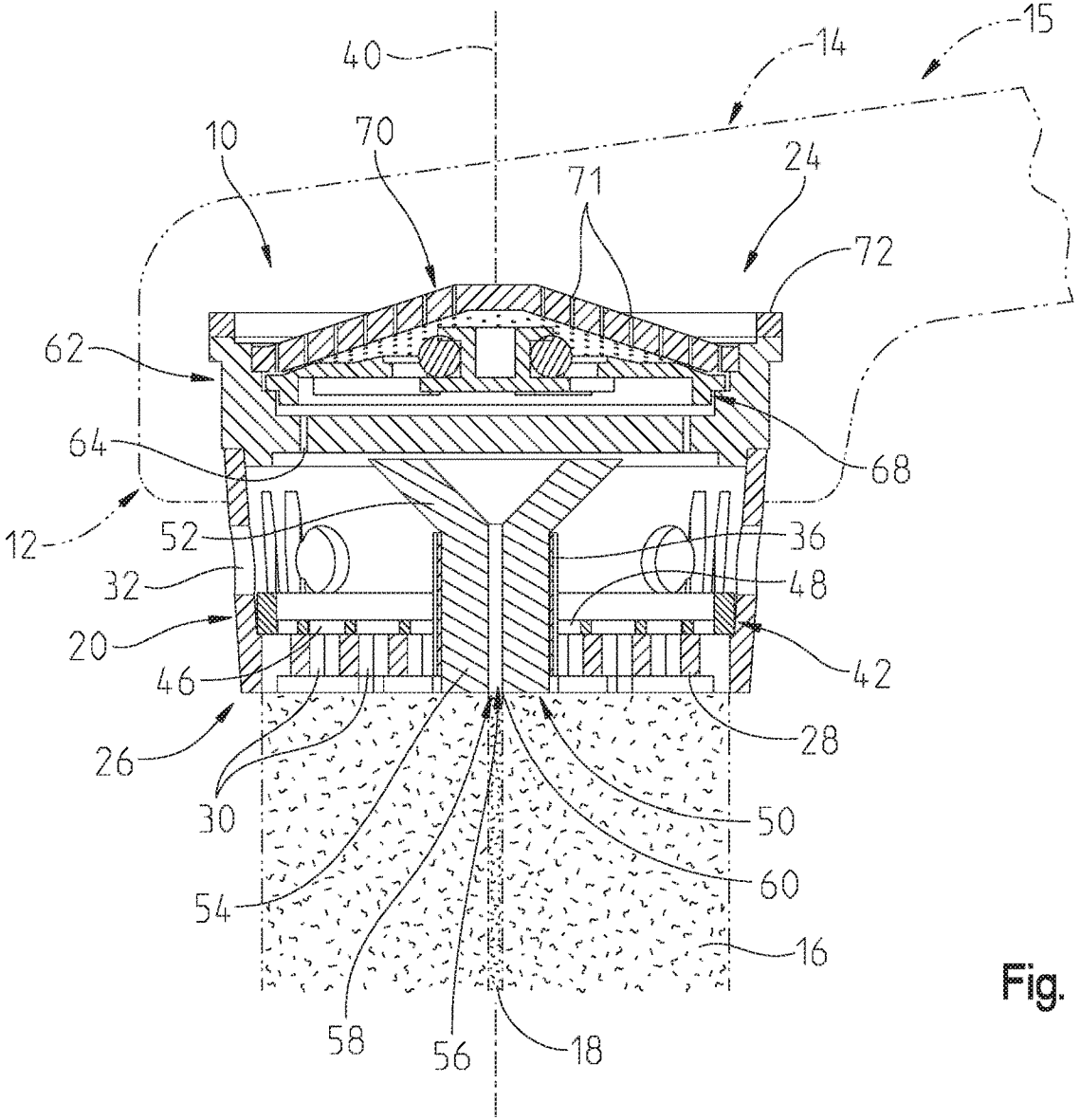
FIG. 2 is a cross-sectional view of an illustrative aerator of the present disclosure coupled to an outlet end of a faucet delivery spout.
Figure 3:
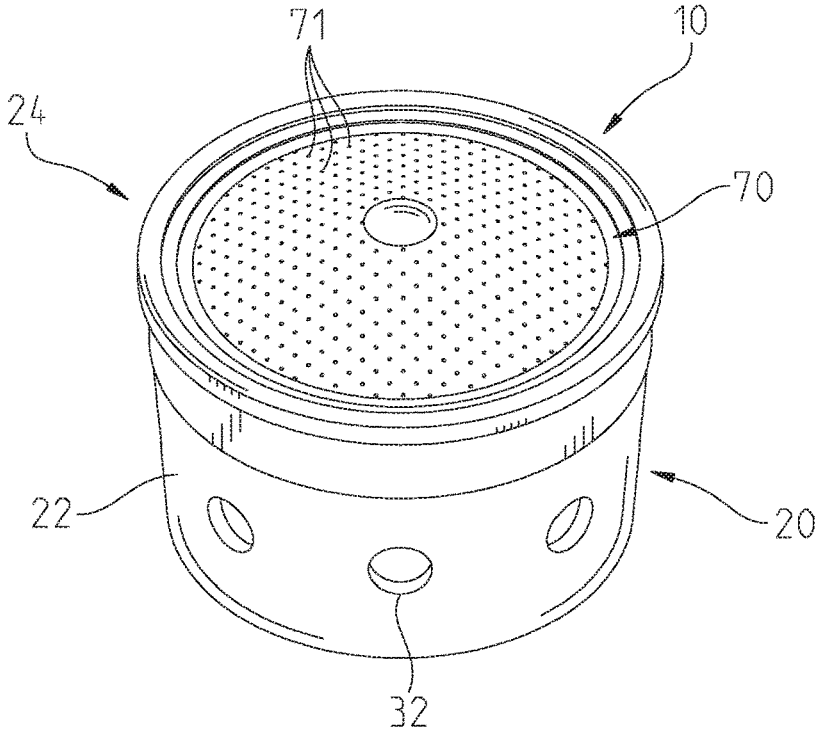
FIG. 3 is a perspective view of an inlet end of the aerator of FIG. 2.
Figure 4:
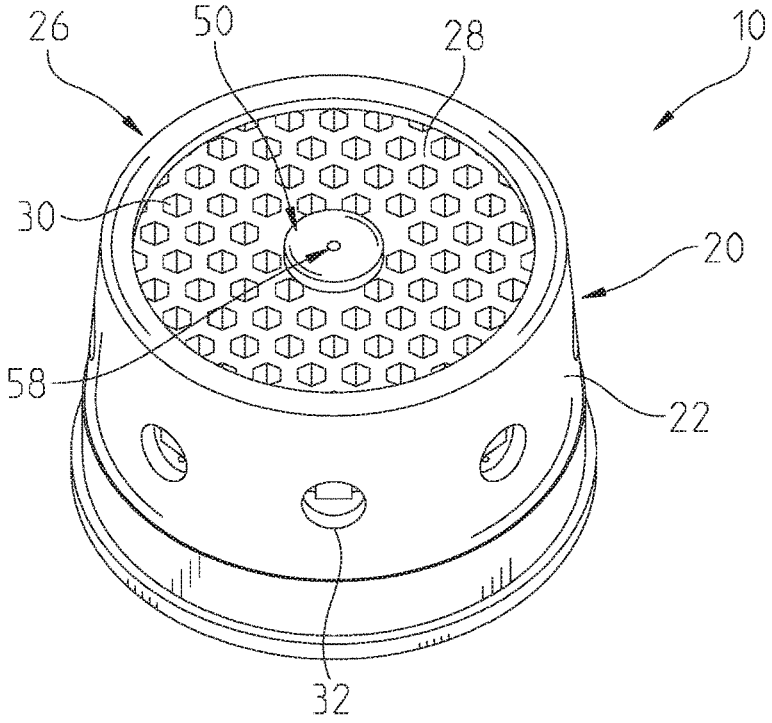
FIG. 4 is a perspective view of an outlet end of the aerator of FIG. 2.
Figure 5:
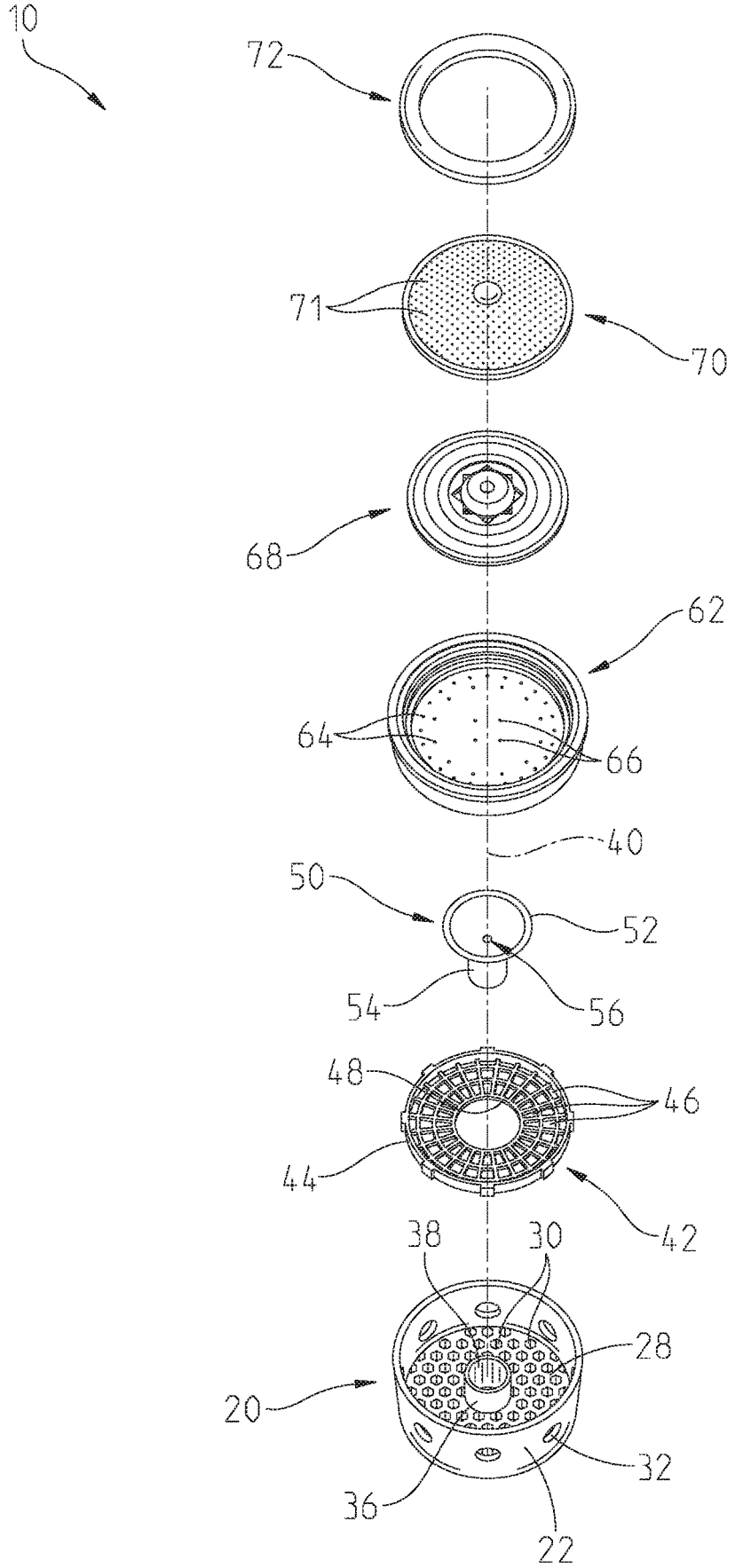
FIG. 5 is a top exploded perspective view of the aerator of FIG. 2.
Figure 6:
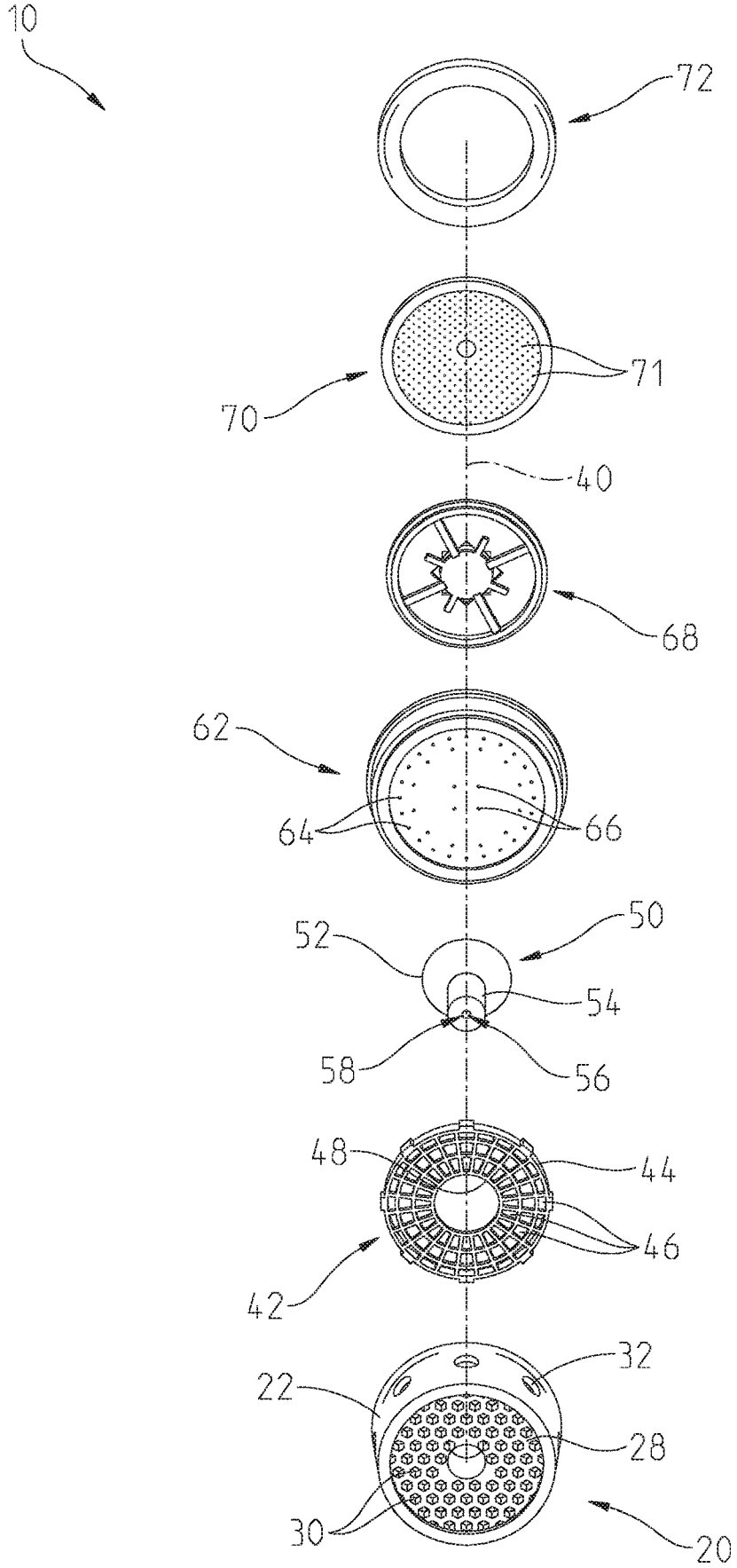
FIG. 6 is a bottom exploded perspective view of the aerator of FIG. 2.

Referring initially to FIGS. 1 and 2, an illustrative aerator 10 of the present disclosure is shown coupled to the outlet 12 of a delivery spout 14 of a faucet 15. As further detailed herein, the aerator 10 is configured to produce a first or peripheral water stream 16 surrounding a second or center water stream 18. The second water stream 18 illustratively has a greater flow velocity than the first water stream 16. As such, the first water stream 16 is a low velocity water stream providing a low impact or "soft" feel to the user, while the second water stream 18 is a high velocity water stream providing a greater impact or "hard" feel to the user. Illustratively, the first water stream 16 is an aerated stream of water, and the second water stream 18 is a substantially laminar stream of water.

With reference to FIGS. 2-6, the aerator 10 illustratively includes an external housing 20 having a cylindrical outer side wall 22 extending between an inlet or upstream end 24 and an outlet or downstream end 26. A base or faceplate 28 is supported by the outer side wall 22 at the outlet end 26. A plurality of openings 30 are formed within the faceplate 28. The openings 30 are illustratively circumferentially spaced apart from each other in a plurality of radially spaced apart rows. A plurality of circumferentially spaced air inlet ports 32 are illustratively formed within the outer side wall 22 of the housing 20, and are in fluid communication with an internal chamber 34 defined by the housing 20 to aerate water flowing from the inlet end 24 to the outlet end 26.

A cylindrical inner side wall 36 illustratively extends upstream (e.g., upwardly) from the faceplate 28, concentrically inwardly from the outer side wall 22, and defines a receiving passageway 38. The receiving passageway 38 is illustratively aligned with a longitudinal axis 40 defined by the outer side wall 22 of the housing 20. An outlet screen 42, including a ring shaped body 44, may be received within the internal chamber 34 adjacent to, and upstream from, the faceplate 28. The outlet screen 42 includes a plurality of openings 46 aligned with the openings 30 of the faceplate 28. A center opening 48 of the outlet screen 42 illustratively receives the inner side wall 36 of the housing 20.

A nozzle 50 is illustratively concentrically received within the receiving passageway 38 and press-fit within the inner side wall 36 of the housing 20. The nozzle 50 illustratively includes an inlet portion or collector, such as a funnel or chamfer 52, for directing water to an outlet portion, such as a flow straightener 54. As shown in FIG. 1, an inner passageway 56 of the flow straightener 54 may include a plurality of inwardly stepped portions **56*a*, 56*b*, 56*c* configured to reduce the inner diameter, thereby defining a restriction and increasing flow velocity, and to assist in straightening water flow and producing a substantially laminar water stream 18 at an outlet 58**.

In the illustrative embodiment of FIG. 2, the inner passageway 56 of the flow straightener 54 may be substantially cylindrical (i.e., smooth with no stepped portions 56*a*, 56*b*, 56*c*). The longer the inner passageway 56 of the flow straightener 54, the less turbulent (i.e., more laminar) the water stream 18 discharged at the outlet 58. The inner passageway 56 illustratively has a relatively small diameter to define a restriction and increase flow velocity, and a relatively lengthy straight section to help align the water and reduce turbulence.

Illustratively, the flow velocity of the second water stream 18 is at least 1.5 times greater than the flow velocity of the first water stream 16. In one illustrative embodiment, the flow velocity of the second water stream 18 is approximately twice the flow velocity of the first water stream 16.

The nozzle 50 may be of different designs configured to provide a high velocity stream 18 with low turbulence. For example, screens and/or parallel ribs may act as flow straighteners to reduce turbulence and facilitate substantially laminar flow.

The outlet 58 of the nozzle 50 illustratively includes a sharp corner or outlet edge 60 to prevent turbulence and assist in generating a substantially laminar flow for water stream 18. While a single central nozzle 50 is illustrated, it should be appreciated that different quantities and locations of nozzles 50 may be incorporated within the aerator 10.

A flow director disc or screen 62 is received within the internal chamber 34 in spaced relation to, and upstream from, the outlet screen 42. A plurality of circumferentially spaced outer openings 64 are in fluid communication with the openings 46 and 30 of the outlet screen 42 and the faceplate 28, respectively. At least one inner opening 66 is in fluid communication with the inlet funnel 52 of the nozzle 50.

A flow restrictor or regulator 68 is illustratively supported within the housing 20 and positioned upstream from, and adjacent to, the flow director disc 62. The flow restrictor 68 may be of conventional design and illustratively restricts the flow rate of water supplied to the flow director disc 62. Illustratively, the flow restrictor 68 limits water flow to no more than 1.2 gallons per minute (gpm). Alternatively, the flow restrictor 68 may limit water flow to other flow rates, for example, 1.0 gallons per minute (gpm).

An inlet screen or filter 70 is illustratively supported by the housing 20 and positioned upstream from, and adjacent to, the flow restrictor 68. The inlet screen 70 may be of conventional design as including a plurality of spaced apart openings 71. The openings 71 are configured to filter out dirt and debris entrained within water entering the aerator 10. A conventional seal or gasket 72 may cooperate with the housing 20 to prevent water leakage between the aerator 10 and the faucet 15.

In operation, water enters from the outlet 12 of the delivery spout 14 of the faucet 15 into the inlet screen 70 at the inlet end 24 of the aerator 10. Illustratively, the water flow rate is limited by the flow restrictor 68. Water is then directed by the flow director disc 62 to either the open internal chamber 34 or to the nozzle 50. Water in the open internal chamber 34 is aerated by air from the inlet ports 32. This aerated water is then discharged from the aerator 10 through openings 46, 30 as the aerated water stream 16. Water directed to the nozzle 50 is restricted by reduced diameter inner passageway 56, resulting in increased flow velocity. Additionally, water within the nozzle 50 is illustratively straightened (i.e., has turbulence reduced) as it passes through the inner passageway 56, and exits through the outlet 58 as the center water stream 18 surrounded by the aerated water stream 16.

Figure 7:
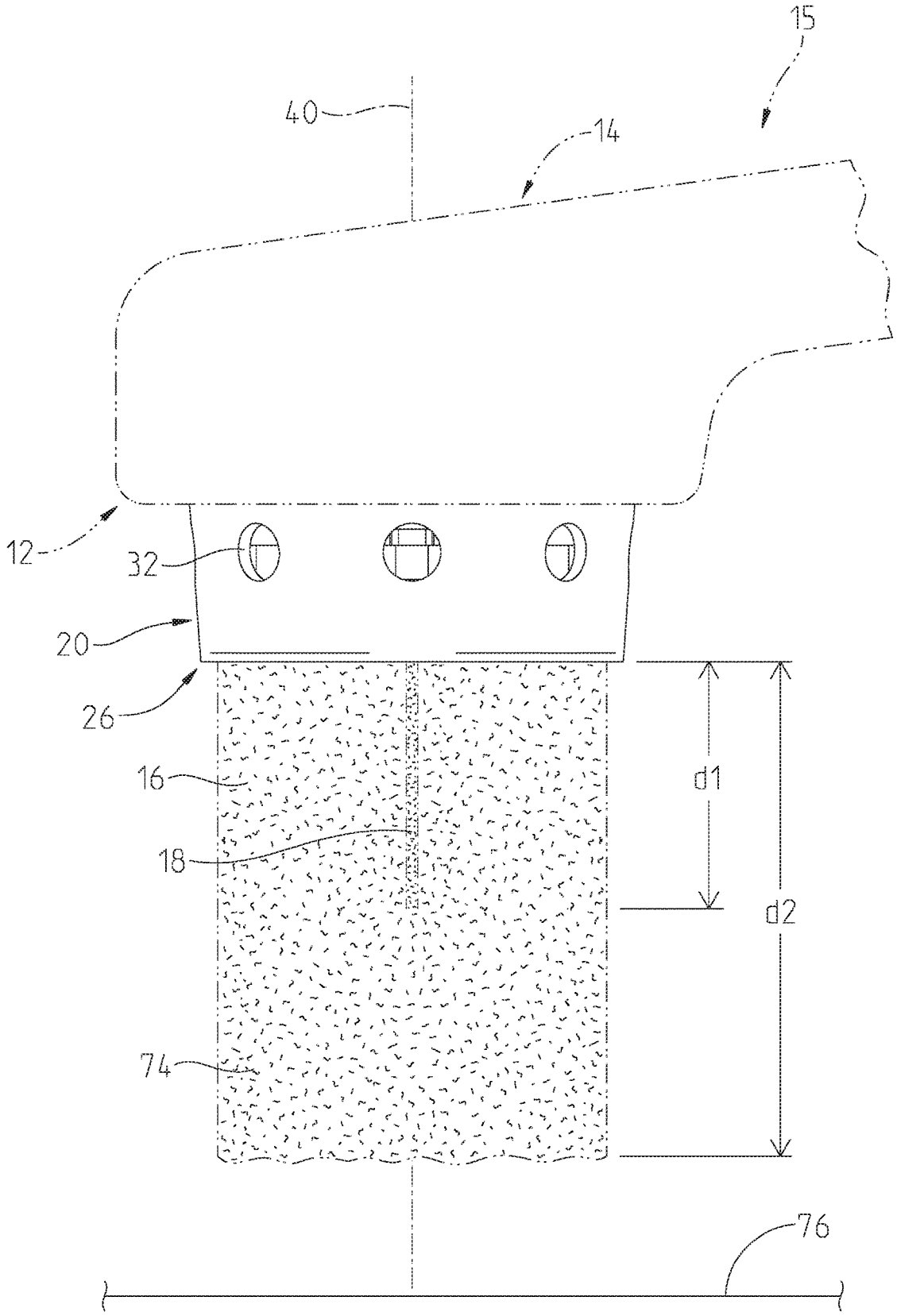
FIG. 7 is a cross-sectional view of illustrative streams dispensed from the aerator of FIG. 2.

With reference to FIG. 7, the aerated water stream 16 surrounding the center water stream 18 may appear to be conventional to the user. The aerated water stream 16 is configured to prevent the center stream 18 (which has a greater flow velocity) from splashing. Illustratively, tasks such as cleaning a razor, cleaning a toothbrush, etc. will be more efficient with the combined streams 16, 18 dispensed from the aerator 10 at a first distance d1 from the outlet end 26 compared to conventional aerators. More particularly, up to distance d1, the center stream 18 with greater flow velocity provides for better cleaning. In an illustrative embodiment, d1 is approximately 1 inch-2 inches.

After distance d1, the center stream 18 blends or disperses into the aerated water stream 16, where at distance d2 from the outlet end 26, the streams 16, 18 have fully blended into a combined water stream 74. At distance d2, the combined water stream 74 has a softer feel for hand washing, and with less splashing by the time it hits a sink basin 76.

Although the invention has been described in detail with reference to certain preferred embodiments, variations and modifications exist within the spirit and scope of the invention as described and defined in the following claims.

The invention claimed is:

1. A faucet aerator comprising:

a housing including an outer side wall, a housing inlet and a faceplate having a plurality of spaced apart openings discharging a first water stream with a first flow velocity;

a nozzle supported by the housing and in fixed position relative to the housing, the nozzle having an inlet with a first diameter, an outlet with a second diameter, and a flow straightener intermediate the nozzle inlet and the nozzle outlet, the first diameter being greater than the second diameter, and the nozzle simultaneously discharging a second water stream with a second flow velocity positioned radially inwardly of the first water stream, the second flow velocity being greater than the first flow velocity;

wherein the inlet of the nozzle includes a decreasing diameter in an axial direction toward the outlet of the nozzle, and the outlet of the nozzle includes an acute annular edge;

wherein the first water stream is an aerated stream of water, and the second water stream is a substantially laminar stream of water;

wherein the plurality of spaced apart openings of the faceplate and the outlet of the nozzle are in continuous fluid communication with the housing inlet; and wherein the outer side wall of the housing includes a plurality of air inlet ports positioned axially downstream from the inlet of the nozzle.

2. The faucet aerator of claim 1, wherein the flow straightener includes an inner surface having a plurality of steps of decreased diameter from the inlet to the outlet.

3. The faucet aerator of claim 1, wherein the nozzle is positioned in the center of the faceplate.

4. The faucet aerator of claim 1, further comprising a flow regulator positioned within the housing, the flow regulator configured to limit water flow to no more than 1.2 gallons per minute.

5. The faucet aerator of claim 1, further comprising an inlet screen supported by the housing.

6. The faucet aerator of claim 5, further comprising an outlet screen supported by the housing downstream from the inlet screen.

7. The faucet aerator of claim 6, wherein the air inlet ports are positioned intermediate the inlet screen and the outlet screen, the air inlet ports configured to impart air into water to generate the aerated stream of water.

8. The faucet aerator of claim 1, wherein the first water stream is concentrically positioned around the second water stream.

9. The faucet aerator of claim 1, wherein the second flow velocity is at least 1.5 times greater than the first flow velocity.

10. The faucet aerator of claim 1, wherein the plurality of air inlet ports are circumferentially spaced within the outer side wall of the housing, and axially positioned intermediate the inlet of the nozzle and the outlet of the nozzle.

11. A faucet aerator comprising:

a housing including an outer side wall and a housing inlet;

a first portion dispensing an aerated stream of water having a first flow velocity;

a second portion in fixed position relative to the first portion, the second portion including an inlet, an outlet, and a flow straightener intermediate the inlet and the outlet, the outlet of the second portion simultaneously dispensing a substantially laminar center stream of water surrounded by the aerated stream of water, the center stream of water having a second flow velocity greater than the first flow velocity;

wherein the inlet of the second portion includes a decreasing diameter in an axial direction toward the outlet of the second portion, and the outlet of the second portion includes an acute annular edge;

wherein the first portion and the second portion are in continuous fluid communication with the housing inlet; and wherein the outer side wall of the housing includes a plurality of air inlet ports in fluid communication with the first portion to aerate water flowing therethrough, the plurality of air inlet ports being positioned axially downstream from the inlet of the second portion.

12. The faucet aerator of claim 11, further comprising: the housing including a faceplate having a plurality of spaced apart openings configured to discharge the aerated stream of water; and the second portion supported by the housing and having the inlet with a first diameter and the outlet with a second diameter, the first diameter being greater than the second diameter, the second portion simultaneously discharging the center stream of water.

13. The faucet aerator of claim 12, wherein the flow straightener includes a body having an inlet, an outlet, and an inner surface having a plurality of steps of decreased diameter from the inlet to the outlet.

14. The faucet aerator of claim 12, further comprising a flow regulator positioned within the housing.

15. The faucet aerator of claim 12, wherein the circumferentially spaced openings discharge an annular first water stream, and the second portion dispenses a cylindrical second water stream, the first water stream concentrically positioned around the first water stream.

16. The faucet aerator of claim 11, wherein the second flow velocity is at least 1.5 times greater than the first flow velocity.

17. The faucet aerator of claim 11, wherein the plurality of air inlet ports are circumferentially spaced within the outer side wall of the housing, and axially positioned intermediate the inlet of the second portion and the outlet of the second portion.

18. A method of dispensing water comprising the steps of:

providing a housing including an outer side wall, a faceplate supported by the housing, and a nozzle supported by the housing and in fixed position relative to the housing, the nozzle having an inlet with a first diameter, an outlet with a second diameter, and a flow straightener intermediate the inlet and the outlet, the first diameter being greater than the second diameter;

wherein the outer side wall of the housing includes a plurality of air inlet ports positioned axially downstream from the inlet of the nozzle;

wherein the inlet of the nozzle includes a decreasing diameter in an axial direction toward the outlet of the nozzle, and the outlet of the nozzle includes an acute annular edge;

discharging a first water stream having a first flow velocity from the faceplate;

discharging a second water stream having a second flow velocity from the nozzle simultaneously and continuously with the first water stream, the second water stream surrounded by the first water stream, and the second flow velocity being greater than the first flow velocity; and wherein the first water stream is an aerated stream of water, and the second water stream is a substantially laminar stream of water.

19. The method of claim 18, wherein the flow straightener includes an inner surface having a plurality of steps of decreased diameter from the inlet to the outlet.

20. The method of claim 18, further comprising the steps of limiting flow to no more than 1.2 gallons per minute.

21. The method of claim 18, wherein the second flow velocity is at least 1.5 times greater than the first flow velocity.

22. The method of claim 18, wherein the plurality of air inlet ports are circumferentially spaced within the outer side wall of the housing, and axially positioned intermediate the inlet of the nozzle and the outlet of the nozzle.

* * * * *